United States Patent [19]

Nilsson

[11] Patent Number: 4,945,663

[45] Date of Patent: Aug. 7, 1990

[54] APPARATUS AND METHOD FOR FORMING AND COMPACTING PLANTING MOUNDS

[76] Inventor: Aston Nilsson, Hässjegatan 5, S-943 00 Öjebyn, Sweden

[21] Appl. No.: 427,985

[22] Filed: Oct. 30, 1989

Related U.S. Application Data

[63] Continuation of Ser. No. 185,903, Apr. 25, 1988, abandoned.

[30] Foreign Application Priority Data

Apr. 28, 1987 [SE] Sweden ..... 8701742

[51] Int. Cl.[5] ..... E02F 3/00; E02F 5/02; B66C 23/00

[52] U.S. Cl. ..... 37/118 A; 37/103; 414/697; 414/715; 172/260.5; 172/777; 172/810

[58] Field of Search ..... 37/118 A, 118 R, 103, 37/124, 129, 127; 172/260.5, 777, 810, 831; 414/697, 702, 715

[56] References Cited

U.S. PATENT DOCUMENTS

| | | | |
|---|---|---|---|
| 618,010 | 1/1899 | Macy | 37/124 |
| 732,621 | 6/1903 | Dreis | 37/127 |
| 744,490 | 11/1903 | Cole | 37/103 |
| 1,398,859 | 11/1921 | Hurtig | 172/260.5 |
| 1,733,123 | 10/1929 | Jackoboice | 172/260.5 |
| 1,843,796 | 2/1932 | Andrews et al. | 37/127 |
| 2,146,807 | 2/1939 | Ferari | 414/697 |
| 2,863,233 | 12/1958 | Johnson | 37/103 |
| 3,003,651 | 10/1961 | Holopainen | 37/103 |
| 3,019,923 | 2/1962 | Morrison et al. | 37/103 |
| 3,023,586 | 3/1962 | Morrison | 37/118 R |
| 3,042,122 | 7/1962 | Anderson | 172/260.5 |
| 3,151,406 | 10/1964 | Fryer | 172/260.5 |
| 3,618,670 | 11/1971 | Alberto | 172/60 |
| 3,724,899 | 4/1973 | Clark | 37/141 T |
| 4,133,121 | 1/1979 | Hemphill | 37/118 R |

FOREIGN PATENT DOCUMENTS

| | | | |
|---|---|---|---|
| 0065153 | 12/1983 | Finland . | |
| 1301492 | 7/1962 | France | 37/118 R |
| 0137328 | 9/1952 | Sweden . | |
| 0235646 | 5/1969 | U.S.S.R. | 37/118 R |
| 0757654 | 8/1980 | U.S.S.R. | 37/118 R |
| 0950861 | 8/1982 | U.S.S.R. . | |

*Primary Examiner*—Edgar S. Burr
*Assistant Examiner*—Kimberly L. Asher
*Attorney, Agent, or Firm*—Shapiro and Shapiro

[57] ABSTRACT

Planting mounds for afforestation purposes and the like are formed by an apparatus wherein a device having at least one mound-forming and compacting body is provided on a movable support arm or boom of a carrier vehicle adapted to be driven along the ground. The body has an elongate, longitudinally concave soil-pushing front surface of shape and dimensions suitable to define the upper surface of a planting mound, and preferably has digging teeth or the like at its lower forward edge. The body is supported for pivotal movement relative to the arm or boom and may be pivoted by a piston-cylinder assembly or the like. For mound formation, the body is placed in a digging position with the soil-pushing surface facing in a first direction substantially parallel to the ground. The body is then moved relative to the vehicle substantially in the first direction, while being maintained in substantially the same orientation so that the soil-pushing surface breaks loose, collects and preliminarily compacts soil material for the mound to be formed. The body is then pivoted to bring the soil-pushing surface to a downward facing position, thus forming the soil material into a planting mound and further compacting the same.

19 Claims, 4 Drawing Sheets

APPARATUS AND METHOD FOR FORMING AND COMPACTING PLANTING MOUNDS

This is a continuation of application Ser. No. 185,902 filed Apr. 25, 1988, now abandoned.

The present invention relates to an apparatus for mound laying in preparation for planting, such as afforestation.

In soil preparation in connection with afforestation, use is currently made of so-called scarifiers for cutting furrows in the ground. An area subjected to such scarification becomes difficult to travel over, another serious drawback being that the elongate furrows may contribute to undesired drainage of water and increased evaporation. The considerable damage to the humus layer and small ground-covering vegetation may also result in rain- and melt water, instead of being retrained in the top soil layer, being drained off to the underlying coarser material so as to be out of the reach of tender plants. The deep furrows cut in the ground also give rise to erosion and impoverishment thereof.

A principal object of the invention is to provide an apparatus which makes it possible, to perform pre-planting excavation, primarily of the humus material, in a more beneficial manner. More particularly, it is an object of this invention to provide an apparatus which collects the excavated; material and compacts it in the form of in planting mounds thereby forming a site which is suited for the plants and which retains the soil moisture to an optimum extent.

Another principal object of the invention is to provide a method of forming and compacting planting mounds which offers the advantages just noted.

The characterizing features of the invention appear from the accompanying claims.

One embodiment of an apparatus according to the invention will be described in more detail hereinbelow with reference to the accompanying drawings. The preferred method of the invention will also be explained in connection with the illustrative apparatus. In the drawings.

Figure 1:
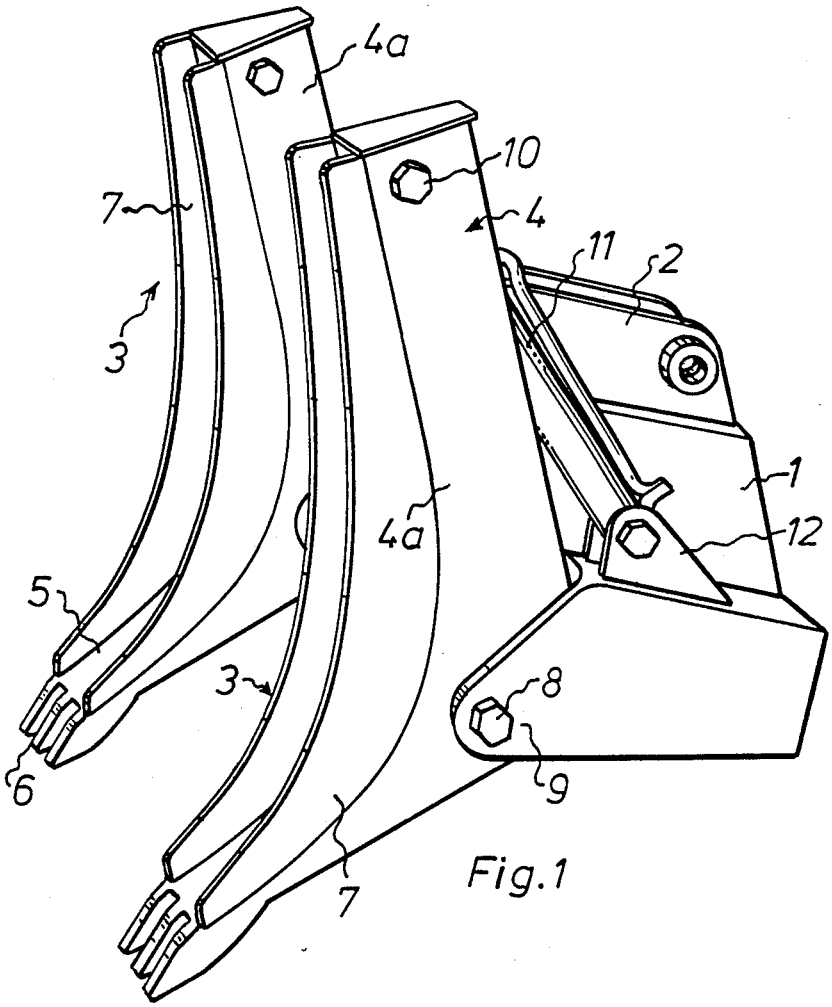
FIG. 1 shows a mound forming and compacting device of the invention, in the digging position.
Figure 2:
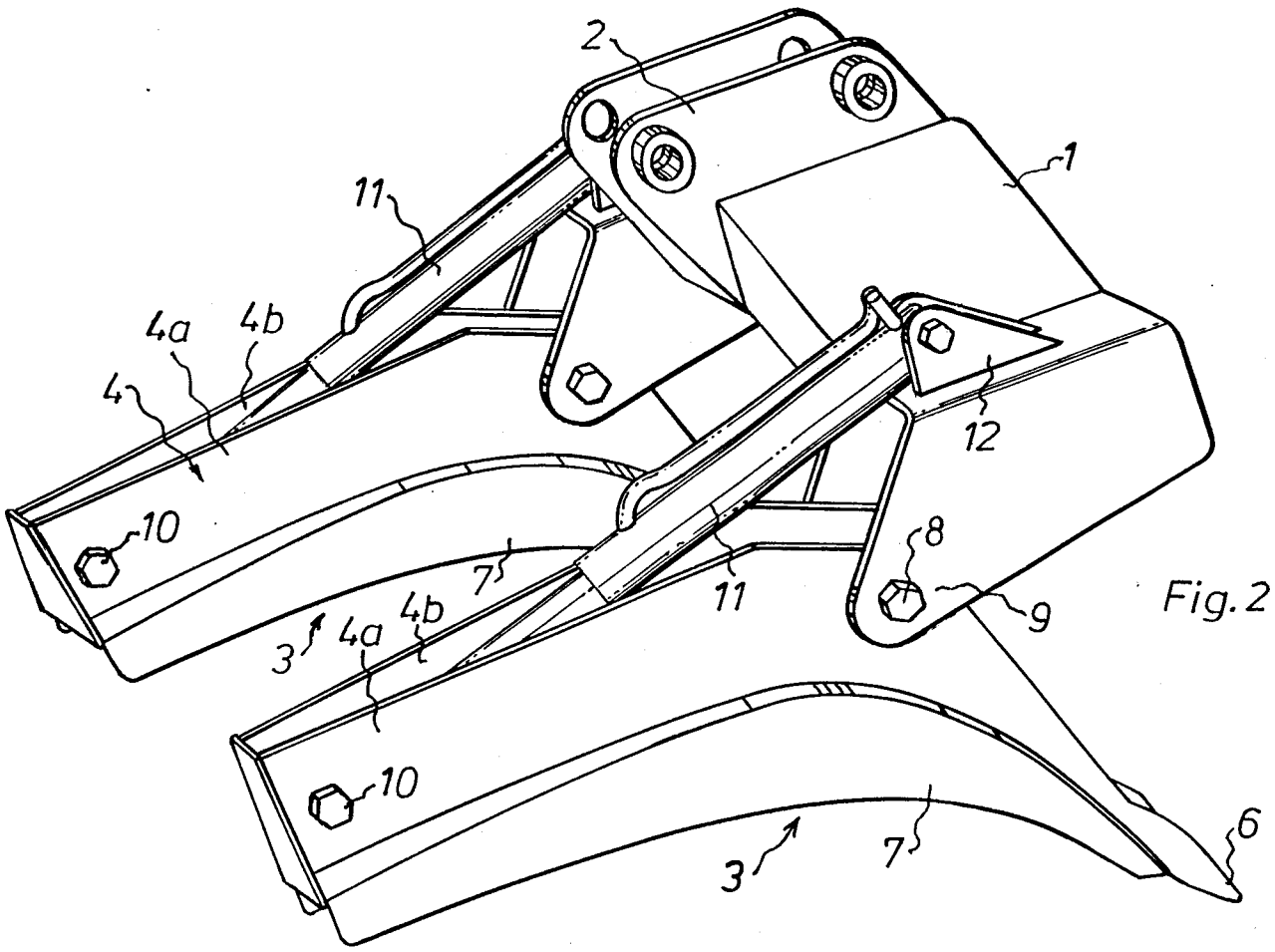
FIG. 2 shows the device in the emptying and compacting position.
Figure 3:
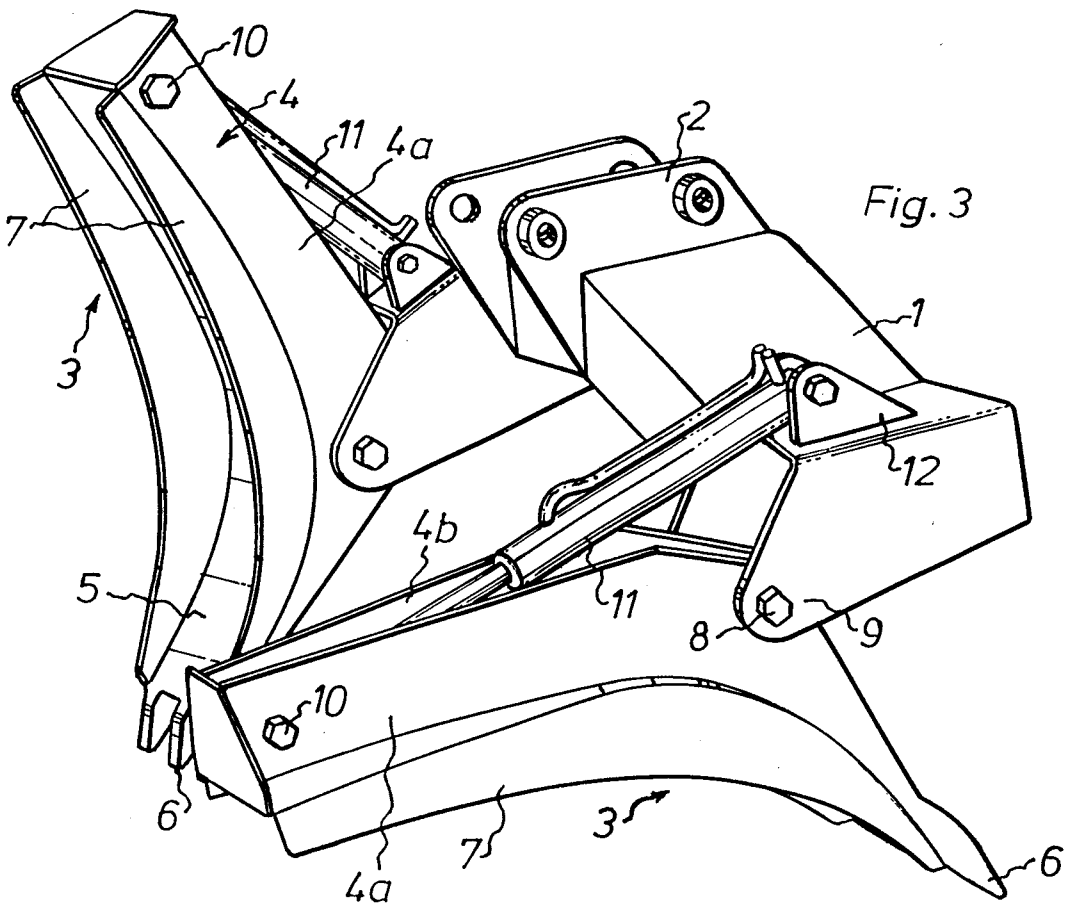
FIG. 3 shows how one bucket of the device has been released due to an obstacle on the ground.
Figure 4:
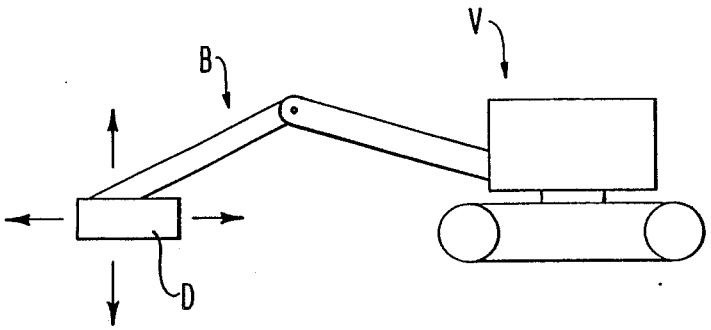
FIG. 4 is a diagrammatic illustration of an apparatus according to the present invention, which may incorporate the device of FIGS. 1–3.

FIGS. 1–3 show a mound forming and compacting device for implementing the present invention. As illustrated diagrammatically in FIG. 4, the device, designated D, is preferably mounted on the end of an arm or boom B of a carrier vehicle V for movement upward and downward relative to the vehicle, as well as toward and away from the vehicle substantially parallel to the ground. Vehicle V is preferably an excavator, but device D may equally well be mounted on an arm which is provided on a caterpillar tractor, a conventional forest tractor, or the like.

In the form shown, device D comprises a transverse beam 1 which is to be rigidly connected to the excavator arm or the like by means of an attachment 2 and bolts. The device further has a selected number of mound forming and compacting bodies 3 pivotally connected to the beam and each having an elongate, longitudinally concave soil-pushing front surface of shape and dimensions suitable to define the upper surface of a planting mound. In the present example, there are two bodies 3 in the form of long, curved but shallow buckets which are hingedly connected to the beam 1. In the illustrated embodiment, two buckets 3 are mounted on the beam, but it is also possible, for example to use three or more buckets depending on the capacity of the excavator and the nature of the ground. Each bucket 3 comprises a body 4 consisting of substantially parallel plates 4*a*, 4*b* to which a base 5 of the bucket is fixed. The base 5, the front surface of which constitutes the soil-pushing surface, and the contiguous rear edges of the plates 4*a*, 4*b*, are curved, and base 5 is also provided at its lower front end with digging teeth 6. On each side of the base 5 of the bucket, there are provided walls 7 which are less curved than the base of the bucket so that the space between the bucket walls is deepest at the center of the bucket.

In the bucket body 4, there are provided upper and lower pairs of holes (not designated in the drawings). Through the lower pair of holes extends a bolt 8 by means of which the bucket is mounted in brackets 9 projecting from the beam 1. At the upper pair of holes, one end - the piston rod end - of a piston and cylinder assembly 11 is pivotally mounted by means of a bolt 10. The other end of the assembly 11 is also pivotally mounted in additional brackets 12 at the beam 1. The piston and cylinder assembly 11 has connections for hydraulic medium.

In the illustrated embodiment, the two buckets are laterally non-displaceable (that is, they are a fixed distance apart along the length of the beam). In an alternative embodiment, one bucket may be displaceable along the beam, such that the distance between the buckets and the digging positions can be varied. In an embodiment using three juxtaposed buckets, the central bucket is suitably laterally non-displaceable, while the outer two buckets are laterally displaceable towards and away from the central one. Such displaceability in the lateral direction and, thus, the possibility of varying the spacing between the planting sites make the appliance extremely useful.

At the beginning of a work cycle, the buckets 3 are in the position shown in FIG. 1. When, by means of the excavator boom or the like, the beam 1 is moved downwards, the bucket and the bucket teeth 6 are pressed into the ground. The excavator boom, and thus the beam 1 with the buckets fixed thereon, are then moved forward for breaking loose, collecting and compacting the soil material in the buckets. When this has been done to a sufficient extent, the piston and cylinder assemblies 11 are operated, causing the buckets 3, without any appreciable lifting thereof, to be tilted to the position shown in FIG. 2, thus compacting the loosened soil material into a planting mound. When the excavator boom, the beam and the buckets have subsequently been lifted, the piston and cylinder assemblies 11 are again operated, returning the buckets to their initial position as shown in FIG. 1. The hydraulic system of each bucket 3 comprises overload sensing means for releasing the piston and cylinder assembly if the bucket operated thereby encounters an obstacle in the form of a rock or the like during the digging operation. Overload sensors for hydraulic piston-cylinder mechanisms are well known and thus need not be described here. FIG. 3 shows how the piston and cylinder assembly of one bucket has been released upon engagement with an obstacle. Instead of the illustrated piston and cylinder assembly, it is of course possible to use other actuating devices.

The fact that the buckets of the apparatus according to the invention do not dig up the soil material as a conventional excavator, i.e. they not lift a volume of soil material and thereafter lay it in a mound, but only push the soil and turn over to finally compact the mounds being formed is an essential feature of the invention. It is of great importance for the planting result that the soil or ground material is not broken up and loosened because it would then become dry in a very short time, resulting in the death of the plants. Planting mounds laid by conventional excavators must generally be left resting for at least one year in order to allow the soil in the mounds to settle before planting can be carried out. In the planting mounds laid by the apparatus according to the invention, planting can be effected immediately.

Soil preparation is suitably carried out by rows. By means of the illustrated apparatus, two holes are first dug, and the machine is then moved such a distance that, in the following digging operation, the next new hole will be dug at the intended distance from the adjacent preceding hole.

The excavator or the like is suitably so arranged that the boom carrying the buckets is at right angles to the direction of travel of the machine, i.e. with the beam 1 parallel to the direction of travel, with the buckets to one side of the machine. If the excavator has a very long boom, two sets of holes can be dug to one side of the excavator, one set adjacent the machine and the other set further away. Thus, two rows of mounds may be formed to one side of the machine as it is moved in the direction of travel. (Where the conditions and the nature of the ground so permit, digging and mound laying can of course also be carried out to the opposite side of the excavating machine after slewing the machine housing through 180°.) Since the rows of mounds will thus be spaced from each other by a considerable distance, the next pass of the machine can be effected overlappingly, the excavator straddling one of the rows already dug while digging a new row of mounds between the rows earlier dug and a further row outwardly thereof.

Since when using the apparatus according to the invention, the excavator boom need only execute a simple, uncomplicated movement downward, forward, upward and away from the machine (the mound being formed and compacted in that the buckets after being pressed downward are moved forward without any lifting thereof and tilted the digging and mound-laying operation can be carried out in a very rapid and reliable manner. In the use of conventional excavators, the emptying of the soil in the bucket is a complicated and time-consuming operation requiring several boom movements. When using a conventional bucket for compacting a mound already laid, this must be done by lifting the emptied bucket and pivoting it so as to turn the bottom of the bucket downwards, whereupon the bucket bottom is used for compacting the mound which is then spread out. By contrast, the simple pattern of movement of the boom and the uncomplicated operation of the buckets in practice of the invention enable the machine operator to easily dig two, three or more holes simultaneously.

The invention considerably cuts working and machine costs and also gives a superior soil preparation result as compared with what can be achieved with previous techniques.

The invention should not be considered restricted to that described above and illustrated in the drawings, but may be modified in various ways within the spirit and scope of the accompanying claims.

What I claim and desire to secure by Letters Patent is:

1. Apparatus for forming and compacting planting mounds, such as for soil preparation prior to afforestation, comprising:

a carrier vehicle adapted to be driven along the ground, boom means mounted to said vehicle for effecting substantially translational movement of an attachment mounted to an end portion of said boom means upwardly and downwardly relative to said vehicle, and toward and away from said vehicle substantially parallel to the ground, and a mound forming and compacting device carried on said boom means and operable in conjuction therewith to form and compact planting mounds, said device including a mound forming and compacting body of substantially greater height than width, and supporting means mounting said body to said end portion of said boom means for substantially translational movement of said body by said boom means as aforesaid, said body including an upwardly elongate, longitudinally concave soil-pushing front surface of shape and dimensions suitable to define the upper surface of a planting mound for afforestation purposes and the like, said soil-pushing surface having digging means formed at a lower forward edge thereof, said supporting means supporting said body on a pivot axis parallel to the width of said body such that in selected positions of said end portion of said boom means, said body may be pivoted on said pivot axis with said soil-pushing surface facing away from said end portion between a first position in which said soil-pushing surface faces in a first direction substantially parallel to the ground and a second position in which said soil-pushing surface faces in a second direction substantially perpendicular into the ground, said supporting means including pivoting means for moving an upper end of said body forward and downward to pivot said body from said first position to said second position and for moving said upper end of said body backward and upward to pivot said body from said second position to said first position, the apparatus being operable to form and compact planting mounds by moving said body with said boom means, first downward to push said digging means into the ground with said body in said first position and then along the ground substantially in said first direction while maintaining said body substantially in said first position so that said soil-pushing surface breaks loose, collects and preliminarily compacts soil material embraced thereby, and thereafter by moving said upper end of said body forward and downward with said pivoting means to pivot said body to said second position, thus forming the soil material into a planting mound and further compacting the same.

2. Apparatus according to claim 1, wherein said pivot axis is roughly mid-way up the height of said body.

3. Apparatus according to claim 1, wherein said pivoting means comprises a piston and cylinder assembly having one end connected to said upper end of said body.

4. Apparatus according to claim 1, wherein said body is a bucket body having said soil-pushing surface at a base thereof and opposite sidewalls extending along its height with front edges that are longitudinally concave, but to a lesser degree than said soil-pushing surface.

5. Apparatus according to claim 1, wherein said device includes a plurality of said mound forming and compacting bodies, and said supporting means includes a beam mounted transversely on said end portion of said boom means, means pivotally connecting said bodies to said beam such that each body may be pivoted between first and second positions as aforesaid, and pivoting means as aforesaid for each body, said bodies being spaced laterally of one another along said beam.

6. Apparatus according to claim 15, wherein the respective pivot axes of said bodies substantially coincide.

7. Apparatus according to claim 6, wherein said bodies are of substantially identical configuration.

8. Apparatus according to claim 5, wherein least one of said bodies is laterally displaceable along said beam for adjustment of the distance between said one body and an adjacent one of said bodies.

9. Apparatus according to claim 5, wherein the pivoting means for each body includes a piston and cylinder assembly having one end connected to said beam and another end connected to said upper end of that body.

10. Apparatus for forming and compacting planting mounds, such as for soil preparation prior to afforestation, comprising:

a carrier vehicle adapted to be driven along the ground, boom means mounted to said vehicle for effecting substantially translational movement of an attachment mounted to an end portion of said boom means upwardly and downwardly relative to said vehicle, and toward and away from said vehicle substantially parallel to the ground, and a mound forming and compacting device carried on said boom means and operable in conjunction therewith to form and compact planting mounds, said device including a mound forming and compacting body of substantially greater height than width, and supporting means mounting said body to said end portion of said boom means for substantially translational movement of said body by said boom means as aforesaid, said body including an upwardly elongate, longitudinally concave soil-pushing front surface of shape and dimensions suitable to define the upper surface of a planting mound for afforestation purposes and the like, said soil-pushing surface having digging means formed at a lower forward edge thereof, said supporting means supporting said body from behind said soil-pushing surface on a pivot axis parallel to the width of said body such that in selected positions of said end portion of said boom means, said body may be pivoted on said pivot axis between a first position in which said soil-pushing surface faces in a first direction substantially parallel to the ground and a second position in which said soil-pushing surface faces in a second direction substantially perpendicular into the ground, said supporting means including pivoting means for moving an upper end of said body forward and downward to pivot said body from said first position to said second position and for moving said upper end of said body backward and upward to pivot said body from said second position to said first position, the apparatus being operable to form and compact planting mounds by moving said body with said boom means, first downward to push said digging means into the ground with said body in said first position and then along the ground substantially in said first direction while maintaining said body substantially in said first position so that said soil-pushing surface breaks loose, collects and preliminarily compacts soil material embraced thereby, and thereafter by moving said upper end of said body forward and downward with said pivoting means to pivot said body to said second position, thus forming the soil material into a planting mound and further compacting the same.

11. Apparatus according to claim 10, wherein said device includes a plurality of said mound forming and compacting bodies, and said supporting means includes a beam mounted transversely on said end portion of said boom means, means pivotally connecting said bodies to said beam such that each body may be pivoted between first and second positions as aforesaid, and pivoting means as aforesaid for each body, said bodies being spaced laterally of one another along said beam.

12. Apparatus according to claim 11, wherein least one of said bodies is laterally displaceable along said beam for adjustment of the distance between said one body and an adjacent one of said bodies.

13. Apparatus according to claim 11, wherein the pivoting means for each body includes a piston and cylinder assembly having one end connected to said beam and another end connected to said upper end of that body.

14. Apparatus according to claim 10, wherein said pivot axis is roughly mid-way up the height of said body.

15. A method of forming and compacting planting mounds, such as for soil preparation prior to afforestation, comprising the steps of:

providing a carrier vehicle adapted to be driven along the ground and carrying a mound forming and compacting device on a boom means thereof for displacing the device upwardly and downwardly relative to the vehicle and toward and away from the vehicle substantially parallel to the ground, the device including a mound forming and compacting body having an elongate longitudinally concave soil-pushing surface of shape and dimensions suitable to define the upper surface of a planting mound for afforestation purposes and the like, the body being supported for pivotal movement relative to the boom means on a pivot axis parallel to the width of the soil-pushing surface and pivotable on said axis by an associated pivot means, and operating the boom means and pivot means in such a manner as to position the mound forming and compacting body in the ground so that the soil-pushing surface has its length oriented generally upright and faces in a direction along the ground, to move the body along the ground in said direction while maintaining the soil-pushing surface in substantially the same orientation so that the soil-pushing surface breaks loose, collects and preliminarily compacts soil material for a planting mound, and to pivot the body to a position in which the soil-pushing surface faces downwardly into the ground, thus forming the soil material into a planting mound and further compacting the same.

16. The method of claim 15, wherein the body is moved in said direction without appreciable lifting thereof.

17. The method of claim 15, including advancing the vehicle in a predetermined direction of travel along the ground, and operating the boom means and the pivot means as aforesaid at successive positions of the vehicle in the direction of travel to form a row of compacted planting mounds.

18. The method of claim 17, wherein two rows of compacted planting mounds are formed respectively at opposite sides of the vehicle by switching the position of the boom means and the mound forming and compacting device back and forth from one side to the other and operating the boom means and the pivot means as aforesaid at each side of the vehicle.

19. The method of claim 15, wherein the mound forming and compacting device has a plurality of said mound forming and compacting bodies spaced laterally of one another with their pivot axes substantially coincident, and wherein the respective pivot means of the bodies are operated jointly for simultaneously forming a corresponding plurality of compacted planting mounds.

* * * * *